US006860331B2

(12) United States Patent
Hagen et al.

(10) Patent No.: US 6,860,331 B2
(45) Date of Patent: Mar. 1, 2005

(54) SINGLE-PIECE MANIFOLD

(75) Inventors: William A. Hagen, House Springs, MO (US); David L. Royse, Wildwood, MO (US)

(73) Assignee: Potter Electric Signal Company, St. Louis, MO (US)

( * ) Notice: Subject to any disclaimer, the term of this patent is extended or adjusted under 35 U.S.C. 154(b) by 139 days.

(21) Appl. No.: 09/988,102

(22) Filed: Nov. 14, 2001

(65) Prior Publication Data

US 2002/0108759 A1 Aug. 15, 2002

Related U.S. Application Data

(60) Provisional application No. 60/267,668, filed on Feb. 9, 2001.

(51) Int. Cl.[7] ..... G08B 37/36; A62C 37/36; A62C 35/00

(52) U.S. Cl. ..... 169/23; 169/20; 169/46; 169/47; 169/16; 169/17; 169/90

(58) Field of Search ..... 169/23, 20, 46, 169/47, 16, 17, 90; 157/505.18, 505.13, 505.14, 515.7, 557; 239/208, 209

(56) References Cited

U.S. PATENT DOCUMENTS

| | | | | |
|---|---|---|---|---|
| 1,699,085 A | | 1/1929 | Vera | |
| 2,166,264 A | | 7/1939 | Piper | |
| 3,857,277 A | | 12/1974 | Moore | 73/28 |
| 4,598,734 A | | 7/1986 | Moyes | 137/515 |
| 4,991,655 A | | 2/1991 | McHugh | 169/16 |
| 5,154,232 A | | 10/1992 | McHugh | 169/23 |
| 5,236,002 A | * | 8/1993 | Martin et al. | 137/119.06 |
| 5,297,635 A | | 3/1994 | McHugh | 169/23 |
| 5,390,744 A | | 2/1995 | McHugh | 169/23 |

OTHER PUBLICATIONS

Potter Electric Signal Company, Residential Riser, Mar. 2000; MFG #5401083–Rev C; pp 1 and 2.
AGF Manufacturing Inc., Residential Riser Pack, date unknown.
Victaulic, Riser Manifold Assembly, Mar. 2001, #3089 Rev A.
Reliable Automatic Sprinkler's Company, Reliable Riser—Residential, date unknown, Bulletin.
Tyco Flow Controls, Riser Manifold, date unknown.

* cited by examiner

*Primary Examiner*—Davis D Hwu
(74) *Attorney, Agent, or Firm*—Ari M. Bai; Greensfelder, Hemker & Gale, P.C.

(57) ABSTRACT

A single-piece manifold for use with a residential or other building sprinkler system is disclosed which comprises a body having an inlet in communication with a water supply and an outlet that communicates with a sprinkler system having a conduit adapted for fluid flow formed between the inlet and the outlet. The body includes a main valve that provides a means of manually shutting off communication with the water supply and a combination pressure relief and test valve for draining and testing the sprinkler system. A pair of check valves are positioned across the conduit for preventing fluid flow therethrough when the sprinkler system is inactive with a space being defined between the first and second check valves for communication with a vent passageway. The vent passageway communicates with atmosphere and prevents false alarms due to water surges in the supply line.

35 Claims, 6 Drawing Sheets

SINGLE-PIECE MANIFOLD

CROSS REFERENCE TO RELATED APPLICATIONS

This application claims benefit of U.S. Provisional Application No.: 60/267,668, filed Feb. 9, 2001.

BACKGROUND OF THE INVENTION

1. Field of the Invention

The present invention relates to sprinkler systems, and more particularly to a single-piece manifold for a sprinkler system. More specifically, the present invention relates to a single-piece manifold that incorporates all of the functions of a multi-piece manifold assembly.

2. Prior Art

Many public and residential buildings are now being built with sprinkler systems for suppressing fires and initiating a fire alarm. As shown in FIG. 1, prior art sprinkler systems commonly include a multi-piece manifold assembly connected to a water supply for providing a potential supply of water for use by a sprinkler system in the event of a fire. A typical multi-piece manifold assembly of the prior art comprises a check valve arrangement 1 for preventing fluid flow from the water supply through the single-piece manifold assembly until activation of the sprinkler system, a flow switch 2 for indicating fluid flow through the single-piece manifold assembly when the sprinkler system is activated, a pressure relief valve 3 for relieving an excess pressure condition inside the single-piece manifold assembly, and a test and drain valve 4 which permits the user to test the entire system for system pressure and drain the system for maintenance. As further shown, the multi-piece manifold assembly includes a network of parts requiring multiple connections which can be difficult and time consuming to assemble. One drawback of the multi-piece manifold assembly of the prior art is that the multiple connections of parts can lead to the possibility that leaks may develop at various connection points along the single-piece manifold assembly. Finally, pressure surges in the water supply line may also cause the check valve arrangement 1 to move which can inadvertently sound an alarm falsely indicating that fluid flow has been initiated through the multi-piece manifold assembly.

Therefore, there is a need in the art for a single-piece manifold of unitary construction that prevents the sounding of a false alarm due to the pressure surges in the sprinkler system. There is a further need in the art for a single-piece manifold having a detection mechanism for detecting the initiation of fluid flow through the single-piece manifold. Finally, there is a need in the art for a single-piece manifold that incorporates all of the functions of a multi-piece manifold assembly.

OBJECTS AND SUMMARY OF THE INVENTION

A primary object of the present invention is to provide a single-piece manifold of unitary construction for use in a sprinkler system and other water delivery systems.

Another object of the present invention is to provide a single-piece manifold which may be easily assembled and connected between a water supply line and a sprinkler system.

A further object of the present invention is to provide a single-piece manifold that activates an alarm when fluid flow is initiated through the single-piece manifold.

Another further object of the present invention is to provide a single-piece manifold that incorporates all of the functions of a multi-piece manifold assembly.

Yet another object of the present invention is to provide a single-piece manifold which will not sound a false alarm when a pressure surge occurs within the water supply line.

Yet a further object of the present invention is to provide a single-piece manifold that prevents back flow of fluid back through the single-piece manifold and into the water supply line.

In brief summary, the present invention overcomes and substantially alleviates the deficiencies present in the art by providing a single-piece manifold for a sprinkler system that provides all the functions of a multi-piece manifold assembly.

Preferably, the single-piece manifold comprises a body having a main housing and a rear housing. The main housing defines a rearward flange and the rear housing includes a clamp having a plurality of resilient fingers which engage the rearward flange in order to attach the main housing to the rear housing. The unitary body of the single-piece manifold further includes a conduit formed therethrough, an inlet communicating with the conduit for connecting the single-piece manifold to a supply of water, an outlet in communication with the conduit for connecting the single-piece manifold to the sprinkler system, a shut off valve movable between an open position in which water may enter the single-piece manifold and a closed position in which water is prevented from passing into the single-piece manifold, a means for monitoring fluid pressure through the conduit, a pair of spaced apart check valves for preventing water from flowing back through the inlet of the single-piece manifold and contaminating the water supply, and a detection mechanism which detects the flow of water through the conduit of the single-piece manifold when the sprinkler system is activated.

In the preferred embodiment, each check valve comprises a valve body having an axially extending hollow tubular member in communication with a hollow nose, guide arms extending from the valve body, and spider arms which extend diagonally from the valve body to the shaft extending axially from the valve body. The shaft of each check valve defines a ball-shaped rear portion at the free end thereof with the rear portion of the first check valve being slidably disposed within the tubular member of the second check valve, while the rear portion of the second check valve is slidably received within a guide tube supported by the body of the single-piece manifold. Each check valve further includes a respective valve seat for fluid tight engagement against each respective valve body when the check valve is in the closed position. In operation, the first and second check valves are slidable between a closed position wherein each check valve engages in a fluid tight seal against a respective valve seat to prevent inadvertent fluid flow through the conduit and an open position wherein fluid flow is initiated through the conduit by activation of the sprinkler system. To provide a fluid tight seal, each check valve is provided with several O-ring sealing elements which are biased against a respective valve seat.

The single-piece manifold further comprises a detection and alarm means for signaling the initiation of fluid flow through the conduit of the single-piece manifold. The detection and alarm means includes a flow switch arrangement which sounds an alarm when the sprinkler system is activated. The flow switch arrangement includes a plunger operatively associated with a flow switch and is slidably received within a tube such that the plunger is moved into and out of contact with the flow switch when the second check valve is placed in the open position. To activate the flow switch, the plunger has a magnet disposed along one end thereof for actuating the flow switch. The flow switch arrangement further includes a metal switch blade attached to a magnet of either the same or opposite polarities as the magnet in the plunger with one end of the switch blade being connected to a positive terminal and the other end to a negative terminal.

When the sprinkler system is activated, fluid flow is initiated through the inlet of the single-piece manifold from the water supply. The pressure applied by the fluid against the first check valve as water enters the conduit of the single-piece manifold overcomes the spring force applied by the spring means to the first check valve and places that valve in the open position. Once the first check valve is opened, water pressure is then applied against the second check valve until the pressure of the water flow also overcomes the spring force applied by the spring means to the second check valve. As the second check valve opens, it moves in a longitudinal direction defined by the valve body of the second check valve. A sloped cam surface formed along the valve body engages the plunger and forces the plunger upward such that the plunger magnet either attracts or repels the magnet attached to the switch blade of the flow switch, thereby establishing a contact point and activating the flow switch which signals an alarm.

The false alarm prevention means of the present invention is the arrangement in series of the first and second check valves with a passageway which communicates with the portion of the conduit between the two check valves that vents excess pressure to atmosphere. The placement of the first and second check valves in series along the conduit of the single-piece manifold in combination with the passageway are configured to dissipate the strength of any random pressure surges generated from the water supply. Moreover, the configuration of the flow switch arrangement being operatively connected with the second check valve prevents the sounding of a false alarm. Because random pressure surges through the conduit are unable to apply a sufficient pressure to unseat both first and second check valves, the alarm is only sounded when the sprinkler system has been activated.

The single-piece manifold further includes a combination pressure relief and test valve comprising a body and a spring-loaded piston received within the body having a tip formed thereon with the body in selective communication with an opening which communicates with the conduit. Actuation of a handle by the user moves the combination valve between a closed position in which the tip engages a valve seat and closes off fluid flow communication to the opening and an open position in which water may flow through the opening and out the combination valve for testing.

In an alternative embodiment of the present invention, the one piece manifold comprises a substantially similar body as found in the preferred embodiment except that the first and second check valves are pivotally mounted flapper valves. The flapper valves are also similarly arranged in series along the conduit of the single-piece manifold behind the main valve such that fluid flow must apply sufficient pressure through the conduit to open both first and second flapper check valves. In operation, activation of the sprinkler system due to a fire initiates sufficient fluid flow through the conduit which opens first and second flapper check valves. As the second flapper check valve pivotally moves open, the magnet disposed in the valve body is brought into close proximity with the magnet of the flow switch arrangement which actuates the flow switch and signals the alarm.

These and other objects of the present invention are realized in the preferred embodiment, described by way of example and not by way of limitation, which provides for a single-piece manifold for a sprinkler system that sounds an alarm when the sprinkler system is activated, prevents the sounding of a false alarm during the occurrence of a pressure surge in the water supply line, permits testing and drainage of the system and prevents any reflux of water back through the conduit.

Additional objects, advantages and novel features of the invention will be set forth in the description which follows, and will become apparent to those skilled in the art upon examination of the following more detailed description and drawings in which like elements of the invention are similarly numbered throughout.

DETAILED DESCRIPTION OF THE INVENTION

Figure 1:
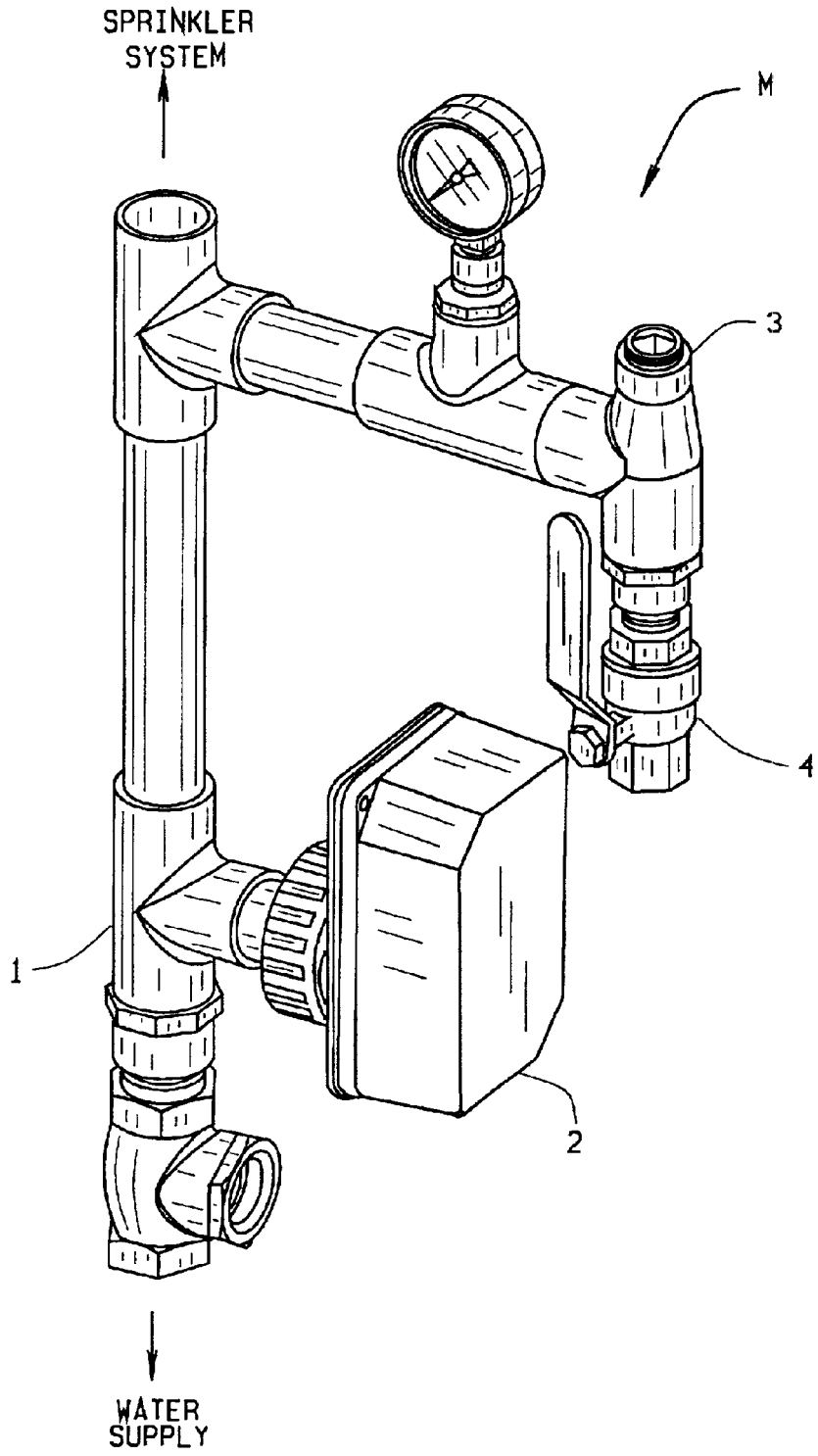
FIG. 1 PRIOR ART
FIG. 1 is a side view of a prior art multi-piece manifold assembly for a sprinkler system.

Referring to the drawings, the preferred embodiment of the single-piece manifold of the present invention is illustrated and generally indicated as 10 in FIGS. 2–5. Manifold 10 comprises a body 12 having a main housing 14 attached to a rear housing 16 with a conduit 18 formed therethrough adapted for fluid flow.

Figure 2:
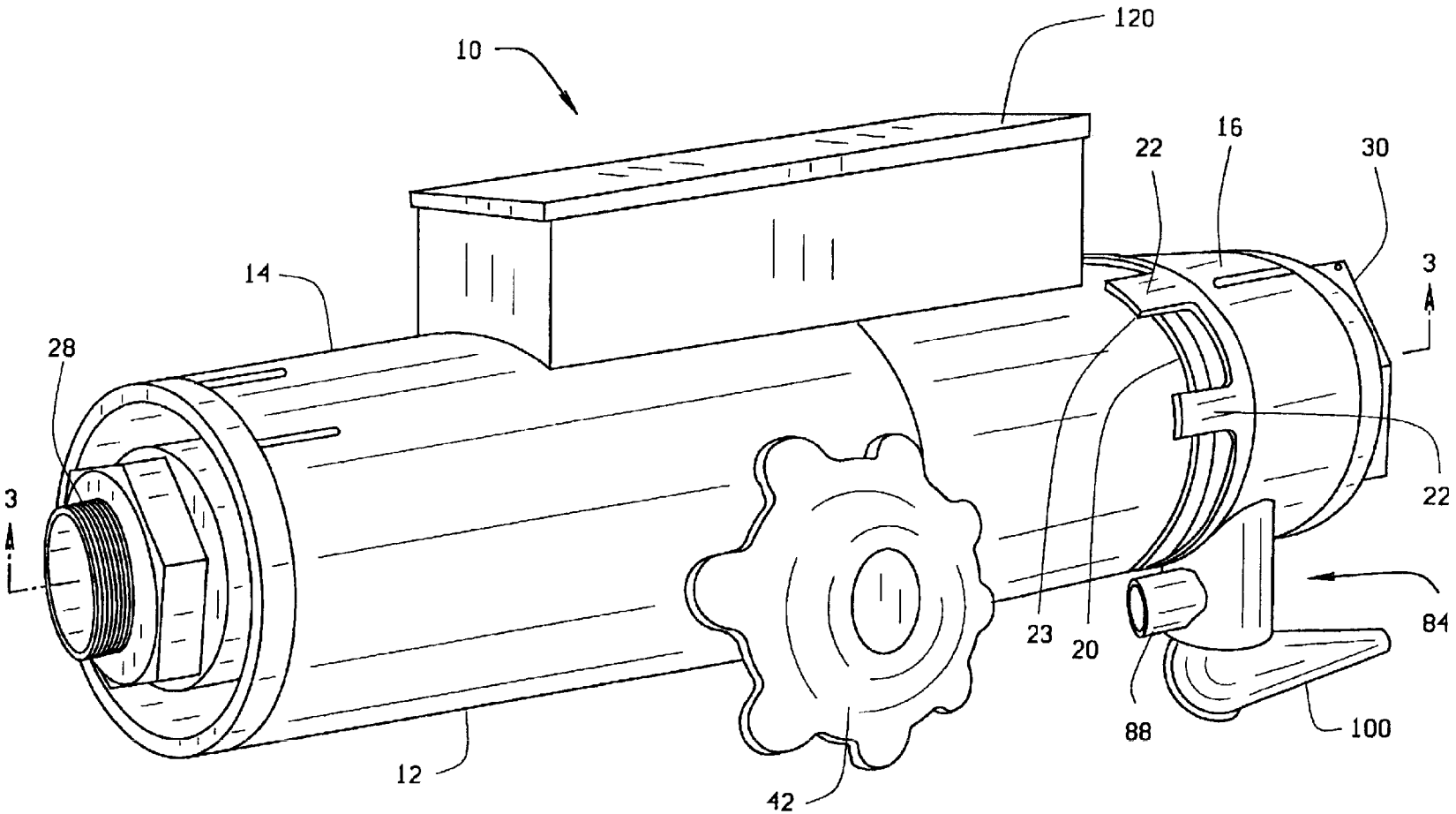
FIG. 2 is a perspective view of the single-piece manifold according to the present invention.
Figure 3:
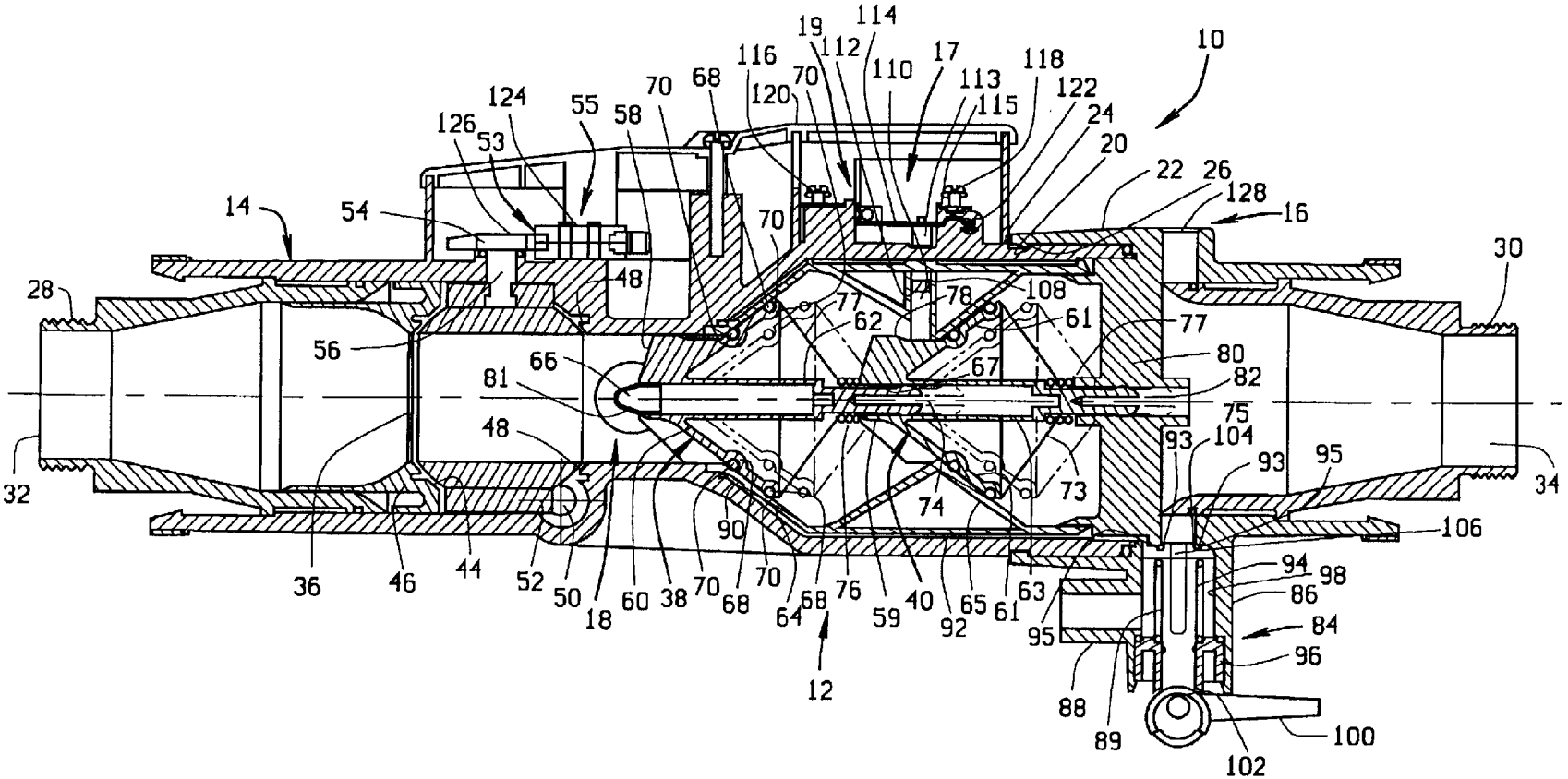
FIG. 3 is a cross sectional view of the single-piece manifold taken along line 3—3 of FIG. 2.
Figure 4:
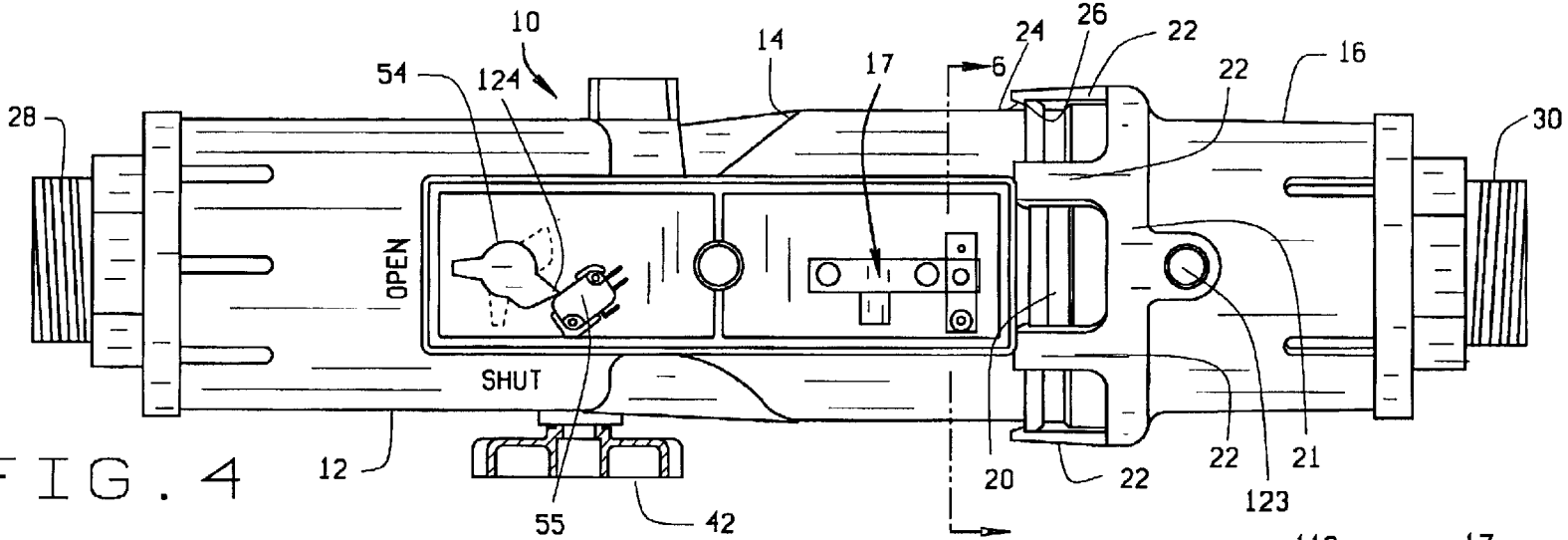
FIG. 4 is a top plan view of the single-piece manifold with a cover removed to show a flow switch arrangement according to the present invention.
Figure 5:
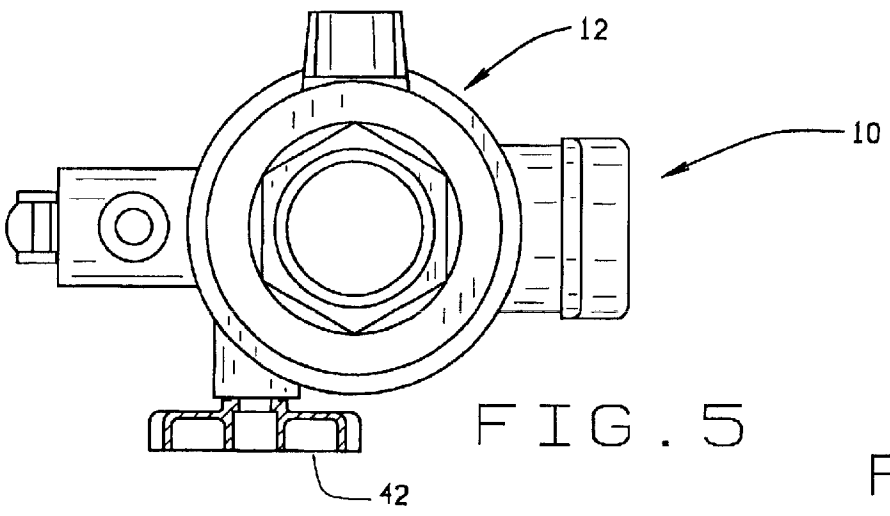
FIG. 5 is a front view of the single-piece manifold taken along line 5—5 of FIG. 4 according to the present invention.

As shown in FIGS. 2, 3 and 4, main housing 14 defines a rear flange 20 which is adapted to engage a clamp member 21 secured to rear housing 16 by a threaded bolt 123. Clamp member 21 comprises a plurality of resilient fingers 22, each having sloped surface 24 and a detent 26 formed along the free end thereof. During assembly of main housing 14 to rear housing 16, fingers 22 engage and expand outwardly as each sloped surface 24 is forced over rear flange 20. When detent 26 passes fully over rear flange 20, fingers 22 relax as each respective detent 26 becomes fully engaged with flange 20, thereby securely attaching main housing 14 to rear housing 16.

As further shown, body 12 comprises a pair of end fittings 28 and 30 which are received in main housing 14 and rear housing 16, respectively, to define an inlet 32 and an outlet 34 at opposed ends of conduit 18 which permits fluid flow through manifold 10. End fittings 28 and 30 are both externally threaded to allow for connection of manifold 10 to a water supply line (not shown) at inlet 32 and sprinkler system (not shown) at outlet 34 using methods well known in the art.

To shut off fluid flow through conduit 18 during periods of maintenance and inspection, a main valve 36 is provided which is disposed across conduit 18 towards the inlet 32 which operates to prevent or allow fluid flow through manifold 10. Preferably, main valve 36 is a fixed ball valve positioned adjacent inlet 32 and mounted across conduit 18, although any suitable valve arrangement which controls fluid flow is felt to fall within the scope of the present invention. Main valve 36 can be rotated between an open position which permits fluid flow into conduit 18 and a closed position which precludes any fluid flow from entering conduit 18 by a handle 42 being rotated by the user. Referring to FIG. 3, handle 42 is mounted on a shaft 50 which manually operates main valve 36 between the closed and open positions. Shaft 50 has worm gears 52 that mesh with the gears (not shown) of main valve 36 for actuating main valve 36. In assembly, main valve 36 securely abuts against an arcuate surface 44 of main housing 14 by a compression nut 46. A pair of ball seals 48 are positioned around main valve 36 for providing a fluid tight seal between main valve 36, compression nut 46, and arcuate surface 44.

To prevent backflow of fluid through conduit 18 as well as prevent the sounding of false alarms, a check valve arrangement comprising first and second check valves 38 and 40 which are spaced apart in series across conduit 18. Preferably, first and second check valves 38 and 40 are substantially identical spring-loaded axially actuated valves positioned behind main valve 36 along conduit 18. First check valve 38 comprises a valve body 58 which is engageable with first valve seat 64, guide arms 60 which extend rearwardly from body 58, and a hollow tubular member 62 that extends axially from valve body 58 having a spherical shaped rear portion 74 formed at the free end thereof. As further shown, valve body 58 defines a hollow nose 66 which communicates with tubular member 62. As further shown, nose 66 of first check valve 38 has a bullet shaped piece 81 which is received therein to seal nose 66. The shape of nose piece 81 prevents fluid flow through conduit 13 from becoming too turbulent. Preferably, nose piece 81 extends beyond the end of nose 66 of check valve 38. A pair of grooves 68 are formed along valve body 58 which are sized and shaped to receive O-rings 70 to provide a fluid tight seal when first check valve 38 is placed in the closed position against first valve seat 64. To bias valve body 58 in the closed position, a first spring 76 is provided along tubular member 62 which applies a spring force against valve body 58 along the longitudinal axis of the first check valve 38 such that valve body 58 is securely seated against first valve seat 64. To provide further structural integrity to first check valve 38, spider arms 72 are provided which extend diagonally from the free end of guide arms 60 to tubular member 62.

Similarly, second check valve 40 comprises a valve body 59 defining a cam surface 78, guide arms 61, and a hollow nose 67 which communicates with a hollow tubular member 63. Tubular member 63 extends axially from valve body 59 having a rear portion 75 formed at the free end thereof. A second check valve seat 65 is sized and shaped to engage valve body 59 in fluid tight engagement thereto when second check valve 40 is placed in the closed position. A plurality of spider arms 73 also extend diagonally from the free end of each guide arm 61 to tubular member 63. Rear housing 16 includes a plurality of spaced apart support vanes 80 which define a cylindrical guide tube 82 in the center of conduit 18. The rear portion 75 of second check valve 40 is slidably received through guide tube 82 when second check valve 40 is placed in the open position. To bias second check valve 40 to the closed position, a spring 77 is provided around tubular member 63 adjacent guide tube 69.

Referring specifically to FIG. 3, the operation of the first and second check valves 38 and 40 shall be discussed in greater detail. When properly assembled, the rear portion 74 of first check valve 38 is slidably received within the hollow nose 67 and tubular member 63 of second check valve 40. In the closed position, valve body 58 is seated in fluid tight engagement against first valve seat 64 such that fluid flow is prevented through conduit 18. When the sprinkler system is activated, the force of fluid flow through conduit 18 from the supply of water overcomes the spring force applied by the first spring 76 such that valve body 58 becomes unseated (shown in phantom) from first valve seat 64. Once unseated, fluid flow through first valve seat 64 begins to contact and unseat valve body 59 of second check valve 40. When the pressure applied by fluid flow against valve body 59 overcomes the spring force applied by second spring 77, second check valve 40 (shown in phantom) becomes unseated from second valve seat 65 and permits fluid flow through outlet 34. One of ordinary skill in the art can appreciate that once the pressure applied by fluid flow through conduit 18 begins to dissipate first and second check valves 38, 40 are biased back by their respective springs 76, 77 as the spring force overcomes fluid pressure. Once biased back, valve bodies 58, 60 reseat in fluid tight engagement against respective valve seats 64, 65, thereby placing first and second check valves 38, 40 in the closed position. Preferably, the pressure generated from the water supply must be at least 175 psi to overcome the spring force applied by first and second springs 76, 77 and place first and second check valves 38, 40 in the open position; however, the present invention contemplates that the necessary pressure may also fall below 175 psi.

Referring back to FIGS. 2 and 3, manifold 10 further includes a combination pressure relief and test valve 84 located behind and adjacent to support vanes 80 for providing a sample of liquid from conduit 18 when so desired by the user or drain the manifold of water during maintenance. Combination valve 84 comprises a tube 86 which communicates with an outlet 88 that functions as a drain and a vent passageway 92 which communicates with outlet 88 and provides a means for venting excess pressure generated inside conduit 18 and prevent false alarms. As further shown, combination valve 84 includes a spring actuated piston 94 which is slidably received within tube 86 and is retained therein by a retainer 96 that receives one end of piston 94 along a sleeve 98. As illustrated, piston 94 defines a piston tip 106 having a seal which seats against a valve seat 104 in fluid tight engagement to close off fluid flow therethrough. To maintain a fluid tight seal when combination valve 84 is in the closed position, a groove 93 is formed around valve seat 106 for receiving an O-ring 95. Piston 94 is operatively connected to a lever 100 that includes a cam surface 102 that seats and unseats piston tip 106 from valve seat 104 whenever lever 100 is actuated by the user.

As further shown, vent passageway 92 communicates with conduit 18 in a space defined between the first and second check valves 38, 40 through an opening 90, while the other end of passageway 92 communicates with the atmosphere through an outlet 88 formed adjacent combination valve 84. When an excess pressure condition, such as a pressure surge from the water supply occurs, the excess pressure is bled from conduit 18 through vent passageway 92 in order to prevent false alarms caused by pressure surges in the water supply which may potentially open both first and second check valves 38, 40.

Figure 6:
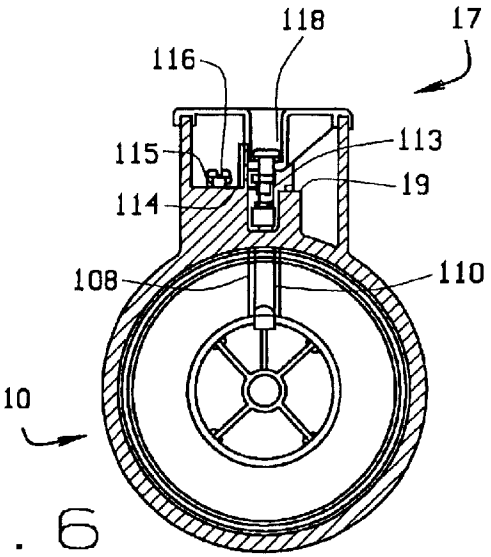
FIG. 6 is a cross sectional view of the single-piece manifold taken along line 6—6 of FIG. 3 showing one aspect of the second check valve according to the present invention.

One aspect of the present invention is to provide a flow switch arrangement 17 which provides a means for sounding an alarm when the sprinkler system is activated and fluid flow is established through both first and second check valves 38, 40. As shown in FIGS. 3 and 4, flow switch arrangement 17 comprises a sleeve 108 positioned directly above second check valve 40 having a plunger 110 slidably received therein. As further shown in FIG. 6, flow switch arrangement 17 comprises a flow switch 19 having a magnet 113 attached to a conductive moving switch blade 114 which is connected to positive terminal 116, while a conductive stationary switch blade 115 is connected to a negative terminal 118.

As noted above, valve body 69 of second check valve 40 further defines a cam surface 78 adapted to engage plunger 110. When water flows through conduit 18 and causes second check valve 40 to unseat and move axially away from second valve seat 65, sloped surface 78 rides under plunger 110 such that plunger 110 is forced progressively upward through sleeve 108. As plunger 110 moves upward magnet 112 comes into close proximity with magnet 113 of flow switch 19. The proximity of the two magnets 112, 113 causes a contact point 122 as moving switch blade 114 comes into contact with stationary switch blade 115. The contact point 112 completes an electrical circuit between positive and negative terminals 116, 118 that signals an alarm at a remote panel (not shown). As further shown, flow switch 19 is encased in a protective housing 120 located on top of main housing 14 which also houses tamper switch arrangement 53.

Referring to FIG. 3, the operation of the tamper switch arrangement 53 will be discussed in greater detail. Tamper switch arrangement 53 comprises a tamper switch 55 for signaling an alarm and a cam arm 54 which is operatively connected to main valve 36 by means of a shaft 56 which simultaneously rotates cam arm 54 whenever main valve 36 is actuated. Cam arm 54 operates to open and close tamper switch 55 which sounds an alarm when the main valve 36 is closed. When cam arm 54 is placed in a closed position by the actuation of main valve 36, cam arm 54 is brought into contact with a switch button 124 of tamper switch 55 which energizes tamper switch arrangement 53 and signals an alarm. Conversely, when main valve 36 is placed in the open position, cam arm 54 is brought out of contact with switch button 124 which de-energizes tamper switch 55 and terminates the alarm.

Another aspect of the present invention is to provide a manifold 10 having the capability of directly measuring fluid pressure inside conduit 18. As shown in FIG. 3, rear housing 16 defines an outlet 128 which directly communicates with conduit 18 and is sized and adapted to receive a conventional pressure gauge (not shown) therein for measuring fluid pressure.

Figure 7:
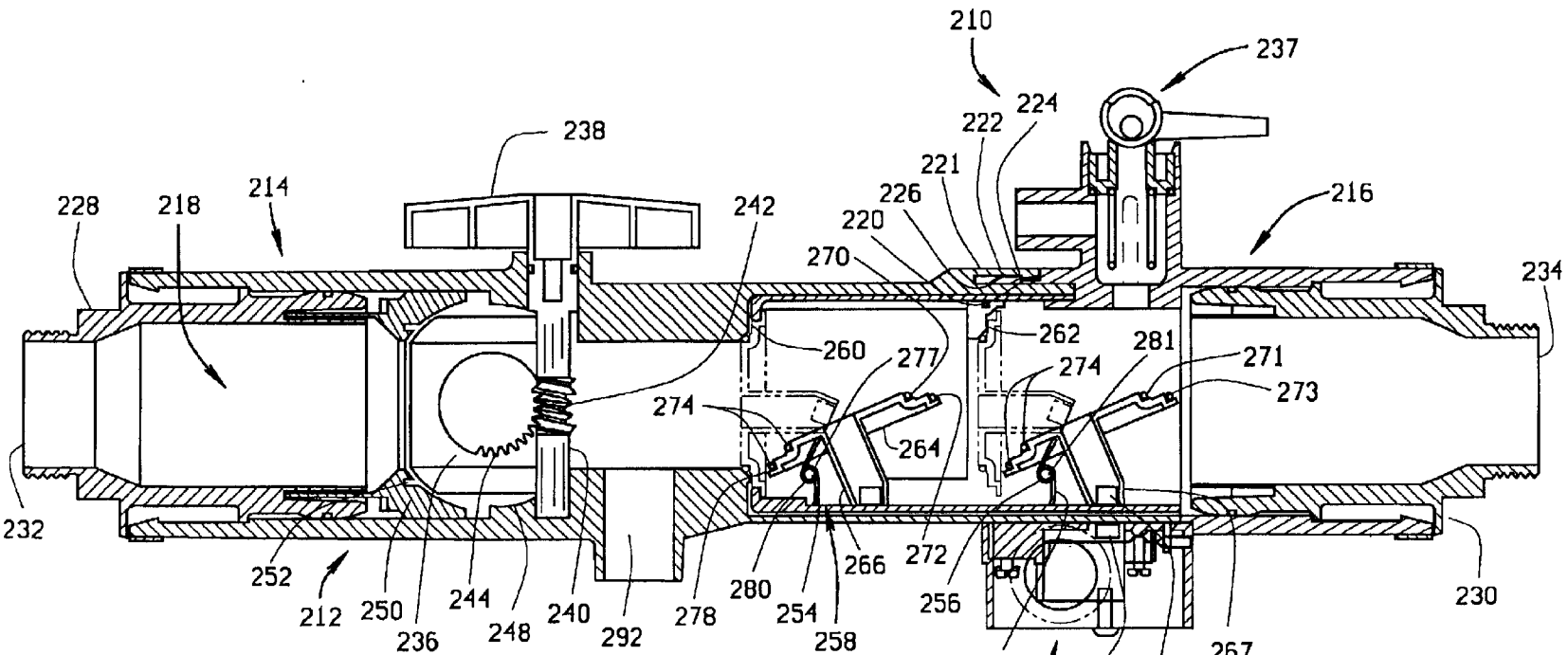
FIG. 7 is a cross sectional view of an alternative embodiment of the present invention.

Referring to FIG. 7, the present invention contemplates an alternative embodiment single-piece manifold 210 which comprises a body 212 having a main housing 214 and a rear housing 216 with a conduit 218 formed therethrough adapted for fluid flow. A clamp member 221 is provided having a plurality of resilient fingers 222 with each defining a sloped surface 224 and a detent 226 at the free end thereof, while rear housing forms a flange 220 adapted to engage clamp member 221. During of assembly of main housing 214 to rear housing 216, fingers 222 expand as each respective sloped surface 224 is forced over rear flange 220. When the detent 226 of each finger 222 fully passes over rear flange 220, fingers 222 relax as detents fully engage with rear flange 220, thereby securely attaching main housing 214 to rear housing 216.

To attach the single-piece manifold 210 with the sprinkler system and the water supply, body 212 is also provided with a pair of end fittings 228 and 230 which are received in main housing 214 and rear housing 216, respectively, to define an inlet 232 and an outlet 234 at opposed ends of conduit 218 which permit fluids to flow through manifold 210.

As with the preferred embodiment, manifold 210 is also provided with a main valve 236 which prevents or allows fluid flow through conduit 218. Preferably, main valve 236 is a fixed ball valve positioned adjacent inlet 232 and mounted across conduit 218. Similar to the preferred embodiment, main valve 236 can be rotated by the user using a handle 238 between a open position which permits fluid flow through conduit 218 and a closed position which precludes any fluid flow through conduit 218. Handle 238 is mounted on a shaft 240 which manually operates main valve 236 between closed and open positions. Shaft 240 has worm gears 242 that mesh with gears 244 of main valve 236 for actuating main valve 236. As further shown, main valve 236 further comprises a tamper switch arrangement (not shown) which operates in substantially the same manner as the preferred embodiment. Main valve 236 is positioned to abut against an arcuate surface 248 of main housing 214 by a compression nut 250. A pair of ball seals 252 are positioned around main valve 236 for providing a fluid tight seal between main valve 236, compression nut 250, and arcuate surface 248.

As distinguished from the axially actuated check valves of the preferred embodiment, manifold 210 comprises substantially identical spring-loaded, pivotally mounted first and second flapper check valves 254 and 256 that checks the flow of water until the sprinkler system is activated and prevents reflux of water back through conduit 218 once fluid flow is initiated. A valve seat assembly 258 is disposed along a portion of conduit 218 and defines first and second valve seats 260, 262 which are sized and shaped to establish a fluid tight seal against first and second check valves 254, 256, respectively when valves 254, 256 are in the closed position.

First check valve 254 has a valve body 264 adapted to seat against first valve seat 260 and defines an axial extension 266 extending from the body 264. Valve body 264 is pivotally mounted to body 212 at a pivot point 280 by a rod 277 inserted therethrough such that first check valve 254 rotates about pivot point 280 when first check valve 254 is biased in either the closed or open positions. To bias valve body 264 in the closed position, a torsion spring 278 is provided about pivot point 280 which applies a spring force against first check valve 254 such that valve body 264 is securely seated against first valve seat 260 in fluid tight engagement thereto, as shown in phantom. To provide this fluid tight seal, valve body 264 further defines a pair of grooves 270, 272 having O-rings 274 of different diameters which establish a fluid tight seal against first valve seat 260. By using O-rings 274 of different diameters, the sprinkler system side of the first check valve 254 will seat the valve body 264 against the inlet pressure caused by the head pressure generated by the water supply.

Figure 7A:
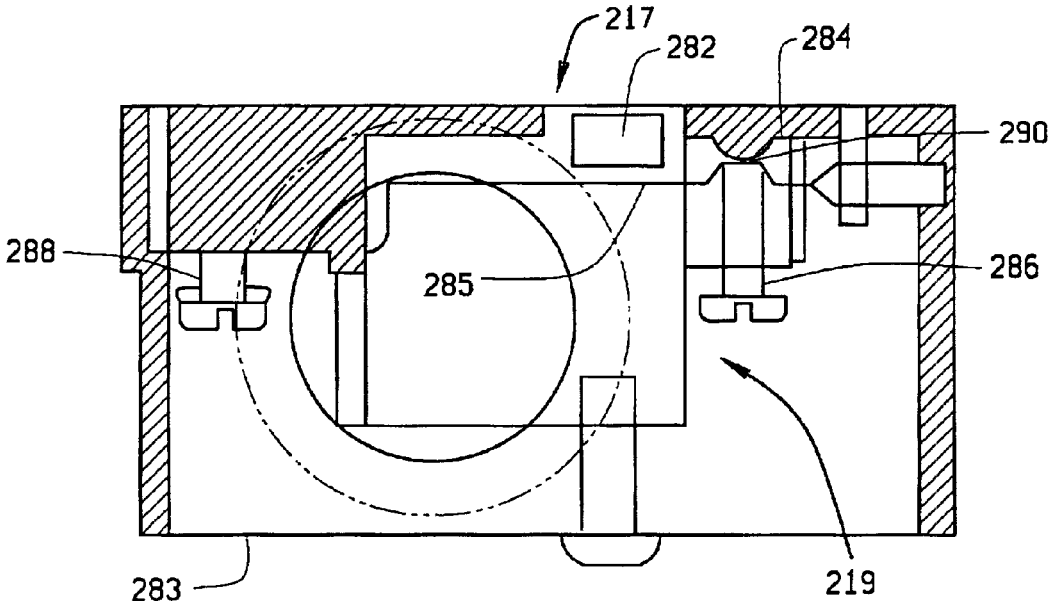
FIG. 7*a* is an enlarged cross sectional view of the flow switch arrangement shown in FIG. 7 according to the present invention.

Similarly, second check valve 256 comprises a valve body 265 adapted to seat against a second valve seat 260 and defines an axial extension 267 extending from body 265. As in the preferred embodiment, manifold 210 also comprises a flow switch arrangement 217 for sounding an alarm when the sprinkler system is activated and fluid flow is initiated. Referring to FIGS. 7 and 7*a*, to sound the alarm the axial extension 267 has a magnet 268 disposed at the free end thereof for actuating flow switch arrangement 217 as shall be discussed in greater detail below. Valve body 265 is also pivotally mounted to body 212 at a pivot point 281 such that second check valve 256 rotates about pivot point 281 when check valve 254 is biased in either the closed or open positions by a torsion spring 279 in a manner similar to first check valve 254. To provide this fluid tight seal, valve body 265 defines a pair of grooves 271, 273 having substantially similar O-rings 274 of different diameters which establish a fluid tight seal against second valve seat 262 when second flapper check valve 256 is in the closed position.

The operation of first and second flapper check valves 254, 256 shall now be discussed. In the closed position, valve body 264 of first flapper check valve 254 is biased in fluid tight engagement with first valve seat 260 which checks the flow of water through conduit 210 until the sprinkler system is activated as well as prevent the reflux of fluid back through conduit 218 once fluid flow is initiated through manifold 210. When the main valve 236 is placed in the open position and sprinkler system is activated, the force of water flow through conduit 218 from the water supply against first flapper check valve 254 overcomes the spring force applied by torsion spring 278 such that valve body 264 (shown in phantom) becomes unseated as valve 254 swings away from first valve seat 260. Once first valve check valve 254 becomes unseated the pressure of fluid flow applied against valve body 265 of the second check valve 256 overcomes the torsion spring force of spring 279 to unseat valve body 265 and permit fluid flow through outlet 234.

One of ordinary skill in the art can appreciate that when the pressure applied by fluid flow through conduit 218 begins to dissipate first and second flapper check valves are biased back by their respective torsion springs 278, 279 as the spring force of each spring 278, 279 overcomes the dissipating fluid pressure. Once biased back, valve bodies 264, 265 reseat against respective first and second valve seats 260, 262 and place first and second check valves 254, 256 in the closed position.

Referrring to FIG. 7*a*, flow switch arrangement 217 provides a means for transmitting a signal and sounding an alarm when the sprinkler system is activated and fluid flow is initiated through conduit 218. Flow switch arrangement 217 comprises a flow switch 219 encased in a protective housing 283 which includes a magnet 282 attached to a moving conductive switch blade 284 connected to a negative terminal 288. As shown, flow switch 219 further comprises a stationary conductive switch blade 285 fixedly attached to the wall of housing 283 which is connected to a positive terminal 286. As noted above, when valve body 265 is rotated away from second valve seat 262, magnet 268 comes into close proximity with magnet 282 of flow switch 219. The proximity of the two magnets 268, 282 causes a contact point 290 as moving switch blade 284 comes into contact with stationary switch blade 285. The contact point 290 completes an electrical circuit between positive and negative terminals 286, 288. One of ordinary skill in the art can appreciate that the flow switch arrangement 217 may be configured such that magnets 268, 282 either repel or attract one another in order to establish contact point 290 such that flow switch 219 is energized and the alarm activated.

Similarly, another aspect of the alternative embodiment is that main valve 236 has a provision for a tamper switch arrangement(not shown) which operates in substantially the same manner as tamper switch arrangement 17 of the preferred embodiment. Referring back to FIG. 7, manifold 210 is also provided with the capability of measuring fluid pressure inside conduit 218 through use of an outlet 292 which is adapted to receive a conventional pressure gauge (not shown).

Preferably, manifold 210 also comprises a test valve 237 which is configured and operates in substantially the same manner as the preferred embodiment for providing a sample of liquid from conduit 218.

Although the present invention discloses a manifold to be used with a sprinkler system, it would be apparent to those skilled in the art that the single-piece manifold could be used with a water supply containing anti-freeze or other liquid, or it could even be used in a dry system, such as an air pressure line.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

We claim:

1. A single-piece manifold for a fire sprinkler system comprising:

a body defining a conduit therethrough, an inlet to said conduit for connecting said manifold to a supply of water, an outlet to said conduit for connecting said manifold to the fire sprinkler system, a main valve in said conduit movable between an open position in which water may enter said body and a closed position in which water is prevented from passing through said body, a check valve arrangement within said conduit for preventing reflux of water back into said water supply, and a vent passageway in communication with said conduit for preventing water from flowing on through to said fire sprinkler system when there is a pressure surge in said water supply.

2. The single-piece manifold of claim 1 wherein said check valve arrangement comprises a first check valve and a second check valve, said first and second check valves being spaced apart; said first and second check valves being slidable between a closed position wherein said first and second check valves engage a respective valve seat to prevent fluid from passing through said conduit and an open position wherein fluid can pass through said conduit.

3. The single-piece manifold of claim 2 wherein each of said first and second check valves includes a valve body, a tubular member, a hollow nose, a guide tube provided in said body, wherein said second check valve's shaft is slidably received in said guide tube supported by said body, and the shaft of said first check valve being slidably received in said hollow nose of said second check valve.

4. The single-piece manifold of claim 3 wherein said first and second check valves include guide arms extending from said valve plug to support said first and second check valves in said conduit.

5. The single-piece manifold of claim 4 wherein th valve seat of said second check valve includes ribs defining channels, said guide arms of said second check valve being received in said channels.

6. The single-piece manifold of claim 2 further including fire alarm means responsive to movement of said second check valve, and means for preventing the sounding of a false alarm.

7. The single-piece manifold of claim 6 wherein said fire alarm means includes a flow switch arrangement which sounds a fire alarm when activated, a plunger which is slidably received in a sleeve to be moved into and out of close proximity with said flow switch arrangement to activate said flow switch arrangement by a cam surface of said second check valve, wherein when said second check valve is moved to an open position, cam surface forces said plunger into contact with said flow switch arrangement to sound said fire alarm.

8. The single-piece manifold of claim 7 wherein said plunger includes a first magnet and said flow switch arrangement includes a second magnet, wherein the close proximity of said first and second magnets cause said fire alarm to sound when said second check valve is placed in the open position.

9. The single-piece manifold of claim 6 wherein said false alarm prevention means comprises a space bounded by said first and second check valves, said space being in communication with said vent passageway and being of sufficient length to smooth out any random pressure surges in said water supply which would otherwise open said second check valve.

10. The single-piece manifold of claim 2 wherein said first and second check valves are biased closed by a spring means.

11. The single-piece manifold of claim 10 wherein the pressure generated by said water supply must be at least 175 psi to overcome said spring means to open said first and second check valves.

12. The single-piece manifold of claim 1 wherein said main valve is operatively connected to a tamper switch so that when said main valve is placed in the open position, said tamper switch is de-energized, and when said main valve is placed in the closed position, said tamper switch is energized and sounds an alarm.

13. The single-piece manifold of claim 1 wherein said vent passageway communicates with atmosphere for venting excess pressure from said space.

14. The single-piece manifold of claim 1 further including a test valve comprising a test valve body having a piston forming a tip thereon, said piston being movable between a closed position in which said tip engages a valve seat and an open position in which water may flow through said test valve.

15. The single-piece manifold of claim 14 wherein said piston is operatively associated with a cam, said piston operating as a cam follower, said cam being rotated by a cam lever, which when turned will move said piston between its open and closed positions.

16. The single-piece manifold of claim 1 wherein said body includes a main housing and a rear housing, said main housing including a rearward flange; said rear housing including resilient fingers which engage said flange to hold said main housing and rear housing together.

17. The single-piece manifold of claim 1, wherein said check valve arrangement comprises a first check valve and a second check valve, said first and second check valves being pivotable between a closed position wherein said first and second check valves engage a respective valve seat to prevent fluid from passing through said conduit and an open position wherein fluid can pass through said conduit.

18. The single-piece manifold of claim 17, wherein said first and second check valves are biased closed by a spring means.

19. The single-piece manifold of claim 18, wherein the pressure generated by said water supply must be at least 175 psi to overcome said spring means to place said first and second check valves in the open position.

20. The single-piece manifold of claim 17, wherein each of said first and second check valves includes a valve body having an axial extension extending from said valve body.

21. The single-piece manifold of claim 20, wherein said valve body is pivotally mounted to said body of said manifold at a pivot point by a rod inserted therethrough, such that said valve body pivots about said pivot point.

22. The single-piece manifold of claim 20, wherein said valve body defines a pair of grooves adapted to receive a sealing means for providing a fluid tight seal between respective valve seat and said valve body.

23. The single-piece manifold of claim 20, further including a flow switch arrangement operatively associated with said second check valve, said flow switch arrangement causing the sounding of an alarm when said second check valve is placed in the open position by the flow of fluid through said conduit.

24. The single-piece manifold of claim 23, wherein said second check valve includes a magnet and said flow switch arrangement includes a magnet such that said flow switch arrangement is actuated and signals an alarm whenever said magnets come into close proximity.

25. A check valve assembly carried by a body of a single-piece fire-sprinkler manifold, said assembly comprising:

a first check valve and a second check valve, said first and second check valves each having a valve body, hollow nose, arid guide arms extending from said valve body, said tubular member of said first check valve being slidably received in said hollow nose of said second check valve to be slidably positioned between a closed position wherein said first check valve engages said hollow nose of said second check valve to prevent fluid flow and an open position wherein said first check valve disengages said hollow nose of said second check valve to permit fluid flow.

26. The check valve assembly of claim 25 wherein said single-piece fire-sprinkler manifold body includes a guide tube and a second valve seat, said tubular member of said second check valve being slidably received in said guide tube to slide between a closed position in which said second check valve engages said second valve seat and an open position wherein said second check valve disengages said second valve seat.

27. The check valve assembly of claim 26 wherein said first and second check valves are spaced apart to define a space, said space being of sufficient length to dampen momentary pressure surges which can open said first check valve, to prevent said momentary surges from opening said second check valve.

28. The check valve assembly of claim 27, further including a vent passageway, wherein said vent passageway as in communication with said space for venting momentary pressure surges inside said conduit to atmosphere.

29. A single-piece manifold for a fire sprinkler system comprising a body having a flowpath therethrough, an inlet to said flowpath for connecting said body to a supply of water, an outlet to said flowpath for connecting said body to said sprinkler system, a first valve and a second valve disposed in said flowpath, and a means for preventing the sounding of false alarms by opening of said second valve caused by a pressure surge in said flowpath, said body further including an area formed between said first and second valves, said first and second valves being moveable between an open position and a closed position, said means for preventing false alarms comprising a vent passageway having one end open to atmosphere to allow said pressure surge to dampen so that said pressure surge will not open said second valve to cause said false alarms.

30. The single-piece manifold of claim 29 further including a first seat associated with said first valve, a second seat associated with said second valve, and an area formed between said first and second valves, each of said first and second valves comprising a valve body which engages its associated seat, said valves being moveable between an open position and a closed position.

31. A single-piece manifold comprising:

a body having a flowpath therethrough, an inlet to said flowpath for connecting said body to a supply of water, an outlet to said flowpath for connecting said body to a sprinkler system, a first valve and a second valve disposed in said flowpath, a flow switch arrangement electrically connected to an alarm for sounding said alarm when activated, a plunger means for activating said flow switch arrangement when fluid flows through said conduit, a sleeve in communication between the flow switch arrangement and said flowpath, said sleeve being positioned above said second valve when said second valve is placed in an open position, said plunger means comprising a plunger slidably received in said sleeve so that when said second valve moves to an open position said second valve engages said plunger to urge said plunger upwards to activate said flow switch arrangement and sound said alarm.

32. The single-piece manifold according to claim 31, wherein said second valve includes a cam surface that forces said plunger into contact with said flow switch arrangement to sound said alarm.

33. The single-piece manifold according to claim 31 wherein said plunger includes a first magnet and said flow switch arrangement includes a second magnet, wherein close proximity of said first and second magnets activates said alarm.

34. The single-piece manifold according to claim 33, wherein said first and second magnets are brought in close proximity when said second valve is placed in the open position and said plunger is forced upwards through said sleeve.

35. The single-piece manifold according to claim 33, wherein said flow switch arrangement further comprises a flow switch having a magnet attached to a conductive moving switch blade connected to a positive terminal, and a conductive stationary blade is connected to a negative terminal, wherein close proximity of said first and second magnets causes said moving switch blade being brought into contact with said conductive stationary blade causing activation of said alarm.

* * * * *